US005389767A

United States Patent [19]

Dobry

[11] Patent Number: 5,389,767

[45] Date of Patent: Feb. 14, 1995

[54] MICROWAVE SUSCEPTOR ELEMENTS AND MATERIALS

[76] Inventor: Reuven Dobry, 87 Rolling Wood Dr., Stamford, Conn. 06905-2331

[21] Appl. No.: 2,154

[22] Filed: Jan. 11, 1993

[51] Int. Cl.[6] ..... H05B 6/80

[52] U.S. Cl. ..... 219/730; 219/759; 426/107; 426/243

[58] Field of Search ..... 219/730, 759, 728, 729; 426/107, 109, 234, 241, 243; 99/DIG. 14

[56] References Cited

U.S. PATENT DOCUMENTS

| | | | |
|---|---|---|---|
| 3,701,872 | 10/1972 | Levinson | 219/730 |
| 4,369,346 | 1/1983 | Hart et al. | 219/730 |
| 4,681,996 | 7/1987 | Collns et al. | 219/759 |
| 4,751,358 | 6/1988 | Durand | 219/10.55 E |
| 4,800,247 | 1/1989 | Schneider et al. | 219/10.55 E |
| 4,822,966 | 4/1989 | Matsubara | 219/759 |
| 4,917,748 | 4/1990 | Harrison | 156/230 |
| 4,959,516 | 9/1990 | Tighe et al. | 219/10.55 F |
| 4,977,302 | 12/1990 | Merigaud et al. | 219/730 |
| 5,006,405 | 4/1991 | Watkins et al. | 428/323 |
| 5,021,293 | 6/1991 | Huang et al. | 428/328 |
| 5,057,659 | 10/1991 | Schneider et al. | 219/10.55 E |
| 5,088,179 | 2/1992 | Gibbon | 426/113 |
| 5,126,519 | 6/1992 | Peleg | 219/10.55 E |
| 5,132,144 | 7/1992 | Parks | 427/210 |

*Primary Examiner*—Philip H. Leung

[57] ABSTRACT

Materials and methods are disclosed for making microwave susceptor elements. The elements of this invention employ substrates, made of solid refractory materials, which are porous and liquid absorbent. The substrates, relatively microwave transparent per se, are rendered microwave interactive by a surface deposit of a finely subdivided microwave responsive substance. The substance is laid down from its dispersion in a volatile liquid medium which is later removed by evaporation. Susceptor elements thus made, be they large pieces or particulates, are uniquely suited for storing microwave generated heat up to elevated temperatures, subject only to the thermal stability of accessory materials. They also perform equally well in conventional ovens. The heat stored may be delivered to load objects during the heating step, in the oven, or afterwards, outside the oven.

17 Claims, 1 Drawing Sheet

MICROWAVE SUSCEPTOR ELEMENTS AND MATERIALS

BACKGROUND OF THE INVENTION

1. Technical Field

This invention relates to microwave technology and, more specifically, to microwave susceptors, i.e. materials capable of generating thermal energy from microwave energy. The invention focuses upon a group of refractory solid materials, porous and relatively microwave transparent per se, that become microwave responsive by a simple process which deposits finely subdivided microwave responsive substances on at least one accessible surface. These microwave susceptible elements are uniquely suited for the storage of microwave generated heat and its delivery to load objects.

2. Description of the Prior Art

It is well known among practitioners of microwave cooking that, speed of preparation notwithstanding, microwave ovens produce results which are quite different from those obtained in conventional ovens. Microwaves heat food essentially throughout by acting upon microwave susceptible components such as water, salts, sugars and the like. Food components which are less microwave interactive do not absorb microwave energy as readily, but heat up by their close proximity to and admixture with receptive components in a constant process of thermal equilibration. In contrast, conventional ovens heat foods by conduction, radiation and convection from the outside in. This method of heating produces surface effects such as browning and crisping which are often desirable but not attainable in an all-microwave oven.

A few microwave ovens now offer added radiant or convective heat in attempts to simulate conventional ovens. Manufacturers of microwave cookware are also trying to address this need by specialized cooking utensils, described as browning grills or skillet browners, which feature microwave susceptible surfaces made of ferritic materials, magnetite and the like. A few noteworthy inventions of this type, some more recent, include a cooking container described in U.S. Pat. No. 4,751,358 and two microwave heating utensils disclosed in U.S. Pat. Nos. 4,800,247 and 5,057,659. Devices in this category are sturdy and reusable. They employ susceptor materials, particulates or matrices, which are permanently bound to or incorporated into thermally conductive substrates, to form integral structures.

Similar considerations have been given to the development of cook-in packaging for foods. In this case, microwave susceptors disposed on the packaging substrate provide directed heat to promote crispness. These are exemplified by a variety of cripsing boards which carry microwave susceptors based on vacuum metallized or metal-sputtered coatings on a polyester film which is laminated to the packaging material. A more recent example of this type, disclosed in U.S. Pat. No. 5,126,519, utilizes a film substrate with a melting point above 500° F. Microwave interactive packaging in this category are commonly used for crisping such foods as french fries, fish sticks, pizza and the like, clearly one-use applications.

Another group of microwave susceptor packaging materials is claimed to be less expensive, yet perform as well as the metallized boards. They are based on particulate susceptor components which are fixed into position with polymeric binders and permanently bound to the packaging substrate. A few notable examples of this type are disclosed in U.S. Pat. Nos. 4,917,748, 4,959,516, 5,021,293 and 5,132,144. Most of them employ finely subdivided solid susceptors in liquid media and methods akin to printing for disposing the susceptors into position. That is followed by similar overcoating steps with heat curable protective substances, which make the finished structure suitable for direct contact with foods.

Presently available microwave susceptors and devices which carry them have much in common. They are designed for relatively fast and intense delivery of heat, in order to produce special effects such as browning and crisping of foods. They are intended primarily, if not exclusively, for use inside the microwave oven. They employ a variety of microwave responsive substances, ranging from metallized to particulate components, frequently more than one. Susceptor coatings employ binders to achieve integrity. They are permanently bonded to their substrates and usually covered by protective layers against abrasion and direct contact with foods. Most susceptor coatings are made by intricate multi-step methods of fabrication and complex processes. Many such coatings include extra components, for special effects, such as flame retarders, heat atenuators, masking agents or visual modifiers.

Where differences do exist, they relate to the specific types of application. Packaging-related susceptors are obviously made to be disposable. Their substrates are poor thermal conductors and rightfully so. Hence, the load object, food, is located on the susceptor side of the substrate. Most of the substrates have limited but sufficient heat stability, for their intended performance, and no heat storage capacity to speak of. By comparison, cooking devices augmented with susceptors are, obviously, permanent and reusable. Their substrates, be they metals or ceramics are good thermal conductors. Hence, their susceptor may be located on sides opposite to and away from the load object. They may also be imbedded in vitreous ceramic structures. Cooking devices employ substrates which, by necessity, must be temperature stable. However, they are neither intended or able to store substantial amounts of heat, given the weight and specific heat of the materials used. Even when they reach extremely high temperatures, they tend to give up their heat quickly by virture of their heat thermal conductivity.

It is clear from the foregoing discussion that microwave susceptors and devices of the prior art which carry them lack certain attributes, among them:

1. Ability to store heat which can extend beyond microwaving.
2. Ability to deliver moderate heat over extended periods.
3. Simple and inexpensive susceptor components and substrates.
4. Simple methods of fabrication.
5. Susceptor components which are safely away from abrasion or contact with load objects, without binders, overcoats and the like.
6. Variety in size, shape and functionality.

Moving in the direction of stored heat and prolonged delivery of such heat, it is noteworthy that many solid materials are naturally microwave responsive. Certain items of pottery and ceramics, all of mineral origin, are known to be microwave interactive by virtue of their chemical and ionic structure. Examples of such materials are Corning's Visions glass, presently in commercial use, and a glass-ceramic containing nepheline which is no longer in use. The latter was actually considered microwave unsafe. Plates made of that material, known as Pyroceram, reached extremely high temperatures in the microwave. Many shattered in explosive force, and their production was discontinued. The use of all-susceptor solids for storage of heat and its sustained delivery is clearly negated by their properties of low specific heat and relatively good thermal conductivity. The first necessitates the use of substantial mass for sufficient heat storage capacity. The second makes high temperature extremes, at outer surfaces, virtually inevitable.

One way the buildup and delivery of heat may be moderated is by making the solid susceptors porous. As the density of the material decreases, it tends to give up stored heat more slowly, by virtue of diminishing thermal conductivity. As the volume of the expanding mass increases, it also presents a larger target for the microwave energy. That may limit the penetration of microwaves into the solid. The solid would thus tend to heat up unevenly, more likely from the outside in. Moreover, its thermal storage capacity would not be fully utilized, even when its surface temperature becomes extremely high. It would clearly be advantageous, therefore, to have the microwave susceptor disposed on the surface of the solid in the first place, rather than throughout the solid. That would greatly diminish the cost of materials and fabrication. It would also make it possible to use, as substrate, any number of pre-existing solid objects which are made to be porous anyway. Such solids, inexpensive and readily available, could in fact be relatively microwave transparent per se.

Accordingly, the objects of this invention are to propose materials and methods for making solid susceptor elements with performance characteristics which include:

1. Unrestricted temperature stability.
2. Ability to store heat.
3. Ability to deliver moderate heat for extended periods.
4. Simple and inexpensive susceptor components and substrates.
5. Simple methods of fabrication.
6. Loosely but practicably surface-bound susceptor components.
7. Safe usage without danger of susceptor component abrasion.
8. No direct contact by susceptor components with heating load objects.
9. Versatile functionality.
10. Dual ovenability.

The feature of dual ovenability is of particular importance in a changing marketplace. Since many all-microwave devices have fallen short of expectations, manufacturers are now inclined to offer dual ovenability to consumers who are not ready to give up their conventional ovens.

SUMMARY OF THE INVENTION

The present invention discloses unique combinations of materials which serve as microwave susceptor elements: The elements are based on solid, refractory substrates which are porous and liquid absorbent. The substrates, possibly microwave transparent per se, are rendered microwave interactive by a surface deposit of a finely sub-divided microwave responsive substance. The process for making such susceptor elements is based on the porosity of the substrate. It coats the substrate with a dispersion of the finely divided microwave responsive substance in a liquid vehicle. Application of the liquid dispersion builds up a deposit on the substrate as the liquid vehicle is absorbed into the substrate. The liquid vehicle is then driven off by evaporation and the surface deposit is treated mechanically to improve its surface adherence and abrasion resistance. The substrates of this invention may be in the form of large pieces of coherent matter or particulates of various sizes and shapes.

BRIEF DESCRIPTION OF THE DRAWINGS

The present invention is illustrated in the accompanying drawings of which.

DESCRIPTION OF THE PREFERRED EMBODIMENTS

Figure 1:
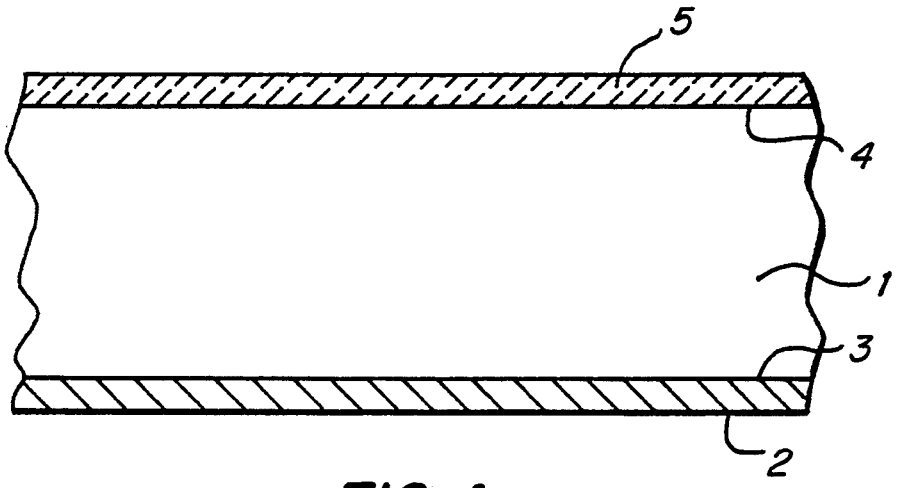
FIG. 1 is a sectional view of substrate coated with a microwave responsive substance on one surface.

Typical substrates which can be used in this invention include unglazed clay pottery, ceramic tiles, sandstone, activated alumina, molecular sieves and the like. An object with a well-defined thickness, such as a tile or a finished piece of pottery, may in fact be partially glazed. Only one of its surfaces needs to be left bare, liquid absorbent and receptive to the application of the microwave responsive coating. A particle, such as activated alumina, is, of course, totally absorbent, ready to accept the coating on its entire surface. Porous solids in coherent or particulate forms deliver stored heat more slowly, but they also heat up more slowly. That is not an unreasonable trade-off for the overall performance desired, particularly dual ovenability.

Typical microwave responsive substances usable in this invention include graphite, magnetite, silicon carbide and the like. The substances need to be finely subdivided enough to form smooth and fairly stable dispersions in a liquid medium. The liquid needs to be volatile, so that it can be easily removed after the deposit of susceptor is laid down on the substrate. Water is clearly preferred for this purpose because it is volatile, inexpensive and perfectly safe to use. Dispersions of graphite in water, for example, actually range in consistency from soft gel to creamy fluid. However, any number of liquids with similar properties may be used for this purpose, as long as they are non-reactive with the materials in question and safe to use in the liquid or vapor state. Surface active agents are helpful in providing stability to the dispersions.

The treatment of the substrate with the liquid dispersion is quite simple. It may consist of a dipping step, with all exposed and liquid absorbent surfaces receiving a uniform coating in the process. It may, alternately, consist of a painting step, with brush or roller, as might be applied to the unglazed surface of a ceramic tile or piece of pottery. Particulate substrates are best treated in a tumble mixer, with blending times and proportions of liquid to substrate sufficient to produce a uniform coating on all particles.

Any and all of the foregoing treatments are then followed by a drying step, to drive off the liquid vehicle. Evaporation of the liquid may be accomplished by conventional heating or microwave heating, with ample ventilation. It may also be done by application of a vacuum, if desired, or combinations of heat and vacuum.

The deposited susceptors which remain after evaporation of the liquid are not permanently bound to the substrates. They are held thereon primarily by virtue of the porosity and surface texture of the substrate. Hence, rough-textured surfaces are preferred. In any case, it is advantageous to treat the deposits mechanically, to improve their surface adhesion and resistance to abrasion. This may be accomplished with graphite, for example, by as simple a step as buffing or rubbing the surface. Other substances may require more elaborate or intensive treatments. The purpose of such treatments is to slide the particles of the deposited coating and drive them further into the rough-textured surface of the substrates. The use of binders is clearly avoided, deliberately, so as not to compromise the temperature stability of the composition.

It should be noted that the susceptor elements of this invention are not meant to be either handled or placed in direct contact with a load object. Load objects for the stored heat can simply be heated by direct contact with an uncoated surface of the substrate, opposite the deposited susceptor. If the load objects are dry, surfaces which come in contact with them need not be liquid impervious. For liquid or moist load objects such surfaces may be made liquid impervious by a refractory glaze. Liquid or moist load objects can also be heated by liquid impervious, outer walls of a vessel which contains particulate susceptors, as will be discussed later.

Figure 2:
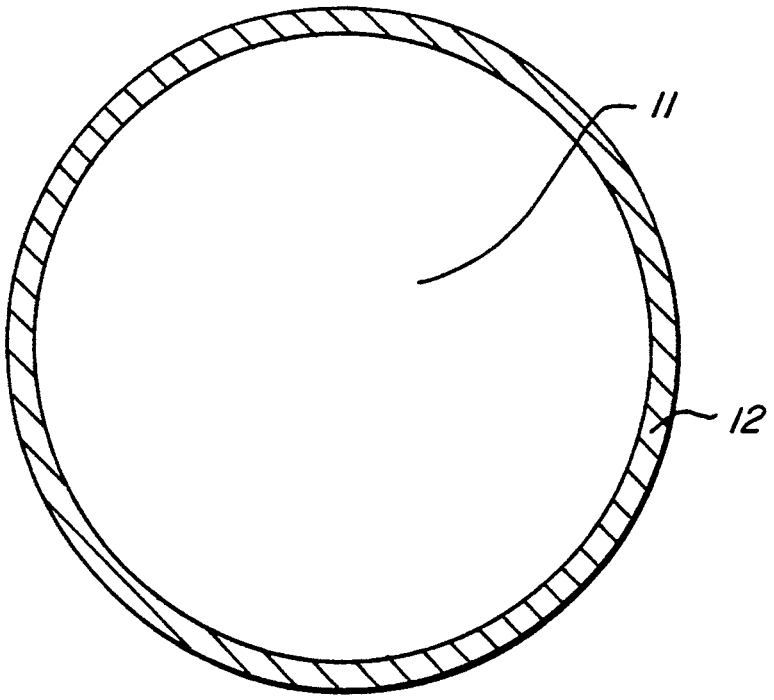
FIG. 2 is a sectional view of a round particle of substrate totally surrounded with a deposit of a microwave responsive substance.

Turning now to the drawings, FIG. 1 shows a piece of substrate 1 coated with microwave responsive substance 2 on surface 3 which happens to be at the bottom of the piece. Surface 4 on the opposite side, the top in this case, carries a liquid impervious glaze 5. FIG. 2 shows a round particle of substrate 11 coated with the microwave responsive substance 12 on its entire surface.

By means of this invention, substrates which are relatively microwave transparent may be rendered microwave responsive, stable and usable over wide temperature ranges. Practical applications of this technology include microwave heatable ceramic tile trivets, microwave heatable items of pottery such as terra cotta and microwave heatable cookware/serveware. All such devices are dual ovenable because their heat storage capability works equally well whether the heat is generated in a microwave oven or absorbed in a conventional oven. In any case, stored heat is delivered more slowly and evenly from porous particulate matter than from coherent porous matter. In effect, the interstitial spaces between the particles create a solid mass with an overall porosity greater than the porosity within each particle. The concept is akin to the difference between bulk density of an aggregate or bed of such particles and particle density of the material per se. It should be noted, however, that beds of particulates coated with susceptors behave like an all-susceptor porous solid, as discussed previously. That means that microwave penetration is limited and the bed does not utilize its full capacity for heat storage. Devices which use particulate susceptors therefore work better if the aggregate or bed of such particles consists of a mixture of fully coated particles and uncoated particles. With microwave penetration thus enhanced, coated particles supply heat to microwave transparent particles and the entire bed is utilized for heat storage.

This and other aspects and advantages of the invention will become more evident from the examples which follow.

EXAMPLE 1

This example and the two following demonstrate microwave heatable trivets. The substrate used was a ceramic tile made by INCEPA of Brazil, measuring 6"×6"×¼", with the top surface glazed. The bottom is, of course, unglazed and liquid absorbent. A dispersion of 20% graphite in water, manufactured by the Graphite Products Company under the trade name GP-100, was diluted with water to a concentration of 6.6% graphite and mixed thoroughly. The diluted dispersion was applied to the bottom of the tile, by a small paint brush, evenly, until its surface was completely covered. A deposit of graphite formed on the treated surface almost immediately as the water vehicle was absorbed by the substrate. Water was removed from the tile, bottom side up, by microwaving. The dry deposit was then buffed to produce a smooth, surface-adherent coating. When the tile was microwaved for one minute at 700 watts on an insulating pad, right side up, it became too hot to touch. The tile retained perceptibly heat, 130° F. or higher, for several minutes.

EXAMPLE 2

A stack of four tiles, with corners cut to form octagons and similarly treated as in Example 1, was unitized by an adhesive tape applied all around the edge of the stack. The tape, comprising woven fiberglass with a silicone adhesive, is made to withstand high temperature. The stack was microwaved at 700 watts for 3 minutes, retaining perceptible heat for at least 30 minutes.

EXAMPLE 3

The stack of Example 2 was mounted into an insulating block comprising cast gypsum with perlite as filler. The complete assembly, measuring about 8" in diameter and 2½" high, was microwaved at 700 watts for 5 minutes. It was then allowed to stand at room temperature, uncovered, retaining perceptible heat for at least one hour.

EXAMPLE 4

This example demonstrates the difference between treated and untreated pottery. A pair of identical quart-sized urns, made of terra cotta clay, glazed inside, were selected for this test. The urns stood about 6" high. They were taper shaped from a bottom diameter Of 3" to a maximum diameter of 5", ending with a flared opening of 3". The internal glaze actually extended over the rim and ended below two side handles about 2" from the top, leaving 4" of outer wall and the entire bottom unglazed and clearly water absorbent. The unglazed surface of one urn was treated as in Example 1. Both urns were microwaved at 700 watts, side by side, for 3 minutes. The treated urn became too hot to touch on all parts but its rim and handles. The untreated urn remained cool; i.e. completely unaffected by the microwaving.

EXAMPLE 5

This example and the next demonstrate cooking with treated pottery. A shallow round casserole measuring 8" in diameter with a height of 1¾", was found to be made of terra cotta clay. As in the urns of Example 4, it carried an inner glaze which extended over the rim and beyond side handles, leaving the bottom unglazed and clearly water absorbent. The casserole was treated on its entire unglazed area as in Example 1 and then fitted into a supporting cradle comprising a size-matched casserole made of PET. The assembly was microwaved at 700 watts for 4 minutes, becoming sizzling hot to the touch. Food cooked on this assembly in the microwave thus received conductive, searing heat from its supporting surface in addition to microwaving from the top.

EXAMPLE 6

The assembly of Example 5 was fitted with a dome-shaped lid, also made of terra cotta and glazed inside. The lid was treated on its outer, liquid absorbent surface as in Example 1. When food was cooked in this covered assembly, it seemed to receive searing heat from below, radiant heat from the cover and some internal heating from microwave energy which penetrated the assembly.

EXAMPLE 7

This example demonstrates the preparation of a particulate susceptor element. Aluminum Corporation of America makes activated alumina in the form of spherical beads. The beads are porous and liquid absorbent. Beads chosen for this purpose measured about 1/16" to ⅛" in diameter, with a porosity specified at 0.75–0.80 cubic centimeters per gram. About 300 grams of these beads were tumble-mixed with 180 grams of a graphite dispersion similar to the one used in Example 1. All of the water vehicle was absorbed into the beads as the dispersion was being spray-added gradually, with a coating of graphite building up on all exposed surfaces of the beads. With all of the dispersion added, the beads were surface-damp but still free-flowing under tumbling. The beads were dried by microwaving and then tumbled again, to produce a buffed surface on the beads.

EXAMPLE 8

This example demonstrates heating effects produced with the particulate susceptor element. A test unit chosen for this purpose consisted of a cylindrical glass cup measuring 2½" in diameter and 3½" in height. The cup was filled with 180 grams of the beads made in Example 7 and microwaved at 700 watts for 1 minute. The temperature attained at the center of the bed was then measured by a digital immersion thermometer, consistently two minutes after cessation of the microwaving. When the cup was filled with all-susceptor particles the temperature at the core reached only 106° F. while the surface of the cup was extremely hot. To check the effect of beds with thinned out microwave responsiveness, the same was repeated with increasing proportions of untreated or native beads added, with the total weight maintained at 180 grams. Results are tabulated below.

| Susceptor Beads | Native Beads | Core Temp |
|---|---|---|
| 100% | 0% | 106° F. |
| 50 | 50 | 250 |
| 40 | 60 | 310 |
| 33 | 67 | 421 |
| 29 | 71 | 429 |
| 25 | 75 | 410 |
| 15 | 85 | 313 |
| 0 | 100 | 200 |

It is clear that native beads are somewhat microwave responsive per se. The effect of diluted susceptor beads is dramatic, with an optimum mixture of 30% susceptor beads and 70% native beads in evidence, based on this configuration.

EXAMPLE 9

This example demonstrates the use of particulate susceptor compositions in a prototype cooking vessel. A double bottomed utensil was formed by matching an 8½" terra cotta saucer with an 8½" Corelle plate. The empty space between the pieces, ranging in depth from 1½ to 2½", was filled with several hundred grams of the optimum particulate composition of Example 8; i.e. 30% susceptor beads and 70% native beads. The pieces were then sealed at their common edge with the type of silicone tape used in Example 2, and fitted with a domed glass cover. The full assembly was microwaved at 700 watts for 6 minutes and then allowed to stand at room temperature on an insulating pad. The plate remained hot to the touch for well over an hour. In a separate test one pint of water in a shallow container was microwaved for two minutes and its temperature rise noted. When the same load was microwaved inside the vessel of this example its temperature rose to 50% of the first test. This indicates that the incident microwaves were split between the heat storing vessel and the intended load. The vessel was not suitable for cooking as assembled. It is expected that food cooked therein would probably take longer to finish. However, it would have the benefit of conductive heat from below and sustained service of the food, hot, in the same utensil.

EXAMPLE 10

This example demonstrates dual ovenability. The assembly of Example 9 was placed in a conventional oven at 375° F. for 40 minutes. It was then allowed to stand at room temperature on an insulating pad. The plate of the assembly remained hot for well over an hour, as in Example 9.

The foregoing description is for the purpose of teaching the person of ordinary skill in the art how to practice the present invention. It is not intended to detail all of those obvious variations and alternatives which will become apparent to the skilled practitioner upon reading the description. It is intended, however, that all such variations and alternatives be included within the scope of the present invention which is defined by the following claims.

I claim:

1. Microwave susceptor elements comprising:

(a) a non-metallic, inorganic, ceramic substrate with at least part of its surface porous, roughly textured and liquid absorbent; and (b) a deposit of finely subdivided microwave responsive substance, laid down from a dispersion of said substance solely in a volatile liquid vehicle, the dried substance being held adherently on said part of the surface of said substrate without the aid of any adhesive, binding or protective agents.

2. The microwave susceptor elements of claim 1 wherein said substrate is in the form of a flat piece, fairly uniform in thickness.

3. The microwave susceptor elements of claim 2 wherein said flat piece is a cut section of a native rock formation or a man-made ceramic object.

4. The microwave susceptor elements of claim 1 wherein said substrate is an item of shaped pottery or earthenware.

5. The microwave susceptor elements of claim 1 wherein said substrate comprises an aggregate of discrete particles.

6. The microwave susceptor elements of claim 5 wherein said particles are made of materials selected from a group comprising activated alumina, molecular sieves, native rock compositions and man-made ceramics.

7. The microwave susceptor elements of claim 5 wherein said particles range in size from U.S. Sieve No. 40 to U.S. Sieve No. 4, or approximately 1/64" to 3/16" in diameter.

8. The microwave susceptor elements of claim 5 wherein the part of said substrate covered by the deposit of microwave responsive substance comprises particles which are totally covered with said deposit.

9. The microwave susceptor elements of claim 8 wherein the rest of said aggregate comprises particles which are not covered by said deposit.

10. The microwave susceptor elements of claim 5 wherein the entire aggregate comprises particles partially covered with said deposit.

11. The microwave susceptor elements of claim 1 wherein said microwave responsive substance is selected from a group including graphite, magnetite, ferrite, silicon carbide, conductive metals and metal oxides.

12. The microwave susceptor elements of claim 11 wherein said microwave responsive substance comprises two or more members of said group.

13. A microwave heatable trivet comprising:

(a) a ceramic tile which is porous, roughly textured and liquid absorbent on its bottom surface; and (b) a deposit of finely subdivided microwave responsive substance, laid down from a dispersion of said substance solely in a volatile liquid vehicle, the dried substance being held adherently on said bottom surface of the tile without the aid of any adhesive, binding or protective agents.

14. A microwave heatable warming or cooking utensil comprising:

(a) a container made of pottery or earthenware which is porous, roughly textured and liquid absorbent on its outer surface; and (b) a deposit of finely subdivided microwave responsive substance, laid down from a dispersion of said substance solely in a volatile liquid vehicle, the dried substance being held adherently on said outer surface without the aid of any adhesive, binding or protective agents.

15. A microwave heatable cook-and-serve utensil comprising:

(a) a double-walled container made of a heat-resistant microwave transparent material;

(b) a refractory substrate in the form of discrete particles, contained within the double-walled space of said container, the surface of said particles being porous, roughly textured and liquid absorbent; and (c) a deposit of finely subdivided microwave responsive substance, laid down from a dispersion of said substance solely in a volatile liquid vehicle, the dried substance being held adherently on at least part of said particles without the aid of any adhesive, binding or protective agents.

16. The microwave heatable cook-and-serve utensil of claim 15 wherein substantially all said particles are partly covered with said deposit.

17. The microwave heatable cook-and-serve utensil of claim 15 wherein a proportion of said particles entirely covered by said deposit is mixed with other particles which are substantially devoid of any deposit, the relative proportions of each having been chosen to maximize microwave heating within the aggregate of particles.

* * * * *